United States Patent [19]

Adamski et al.

[11] Patent Number: 4,828,450

[45] Date of Patent: May 9, 1989

[54] UNIVERSAL FORK-SUPPORTED PUSH-PULL SLIP SHEET HANDLING ATTACHMENT FOR FORKLIFT TRUCKS

[75] Inventors: Donald F. Adamski, Beaverton; Emmett C. Frison, Portland, both of Oreg.; Randall W. Matthewson, Longview, Wash.

[73] Assignee: Brudi Equipment, Inc., Kelso, Wash.

[21] Appl. No.: 692,285

[22] Filed: Jan. 16, 1985

[51] Int. Cl.[4] ..... B66F 9/14

[52] U.S. Cl. ..... 414/607; 414/661

[58] Field of Search ..... 414/607, 608, 280, 659, 414/661–663, 785, 497, 667, 686, 732

[56] References Cited

U.S. PATENT DOCUMENTS

| | | | |
|---|---|---|---|
| 2,701,658 | 2/1955 | Radin et al. | 414/607 |
| 2,957,594 | 10/1960 | Brenneman | 414/607 |
| 3,071,268 | 1/1963 | Wales | 414/607 |
| 3,180,513 | 4/1965 | Vander Wal | 414/607 |
| 3,182,833 | 5/1965 | Lull | 414/732 |
| 3,310,189 | 3/1967 | Vander Wal | 414/607 |
| 3,640,414 | 2/1972 | Brudi | 414/661 |
| 3,809,264 | 5/1974 | Mayers | 414/608 X |
| 3,885,692 | 5/1975 | Anderson, Jr. | 414/661 X |
| 4,065,012 | 12/1977 | Rocco | 414/497 |
| 4,165,008 | 8/1979 | Faust et al. | 414/667 X |
| 4,205,938 | 6/1980 | Olson | 414/497 |
| 4,230,434 | 10/1980 | Seaberg | 414/607 |
| 4,274,794 | 6/1981 | Olson | 414/663 |
| 4,275,984 | 6/1981 | Lenertz | 414/686 |
| 4,286,913 | 9/1981 | Rowe et al. | 414/607 X |
| 4,300,867 | 11/1981 | Frees | 414/497 |
| 4,304,305 | 12/1981 | Bartel | 414/686 X |
| 4,330,231 | 5/1982 | Brewer | 414/607 X |
| 4,406,575 | 9/1983 | Gaibler | 414/667 |
| 4,482,286 | 11/1984 | Farmer et al. | 414/607 |
| 4,488,832 | 12/1984 | Kinshofer | 414/607 X |
| 4,619,579 | 10/1986 | Frison | 414/607 |

*Primary Examiner*—Robert J. Spar
*Assistant Examiner*—David A. Bucci
*Attorney, Agent, or Firm*—Klarquist, Sparkman, Campbell, Leigh & Whinston

[57] ABSTRACT

A load handling attachment for a forklift truck has an upright base, a load engaging platen, and a push-pull assembly connected to the base above the platen. The attachment also includes a device for connecting the base frame to a carriage of the forklift truck to resist forward movement of the base relative to the carriage. The connecting device includes a linearly movable device mounted on a side frame member of the base, the linearly movable device engaging an upright fork portion when in a carriage attaching position.

23 Claims, 8 Drawing Sheets

P
50
51
82
86
70
88
90
58
54
64
62
74
76
12
14
15
52
13

UNIVERSAL FORK-SUPPORTED PUSH-PULL SLIP SHEET HANDLING ATTACHMENT FOR FORKLIFT TRUCKS

BACKGROUND OF THE INVENTION

The present invention relates to push-pull slip sheet handling attachments for forklift trucks and especially to such attachments that are fork-supported.

Traditionally, packaged or containerized loads have been stacked on wooden pallets for handling by high-lift vehicles such as forklift trucks and self-propelled or manually-operated low-lift vehicles known as pallet trucks, hand jacks or "walkies." The conventional narrow forks of such vehicles are inserted into openings in the pallets for lifting, transporting and stacking or unstacking the loads.

In the last decade, thin fiber or plastic slip sheets have been used increasingly instead of pallets to handle loads because of their greater convenience and lower cost. However, high-lift and low-lift vehicles equipped with standard, narrow forks (typically 4 to 6 inches wide) for handling pallets are inadequate for handling loads on slip sheets because of the small load-supporting surface area of the forks. Therefore, such vehicles have been equipped with wide forks or platens to support slip-sheeted loads instead of conventional narrow pallet forks. In addition, such vehicles must be equipped with a push-pull attachment which typically includes a push plate connected to a rear frame by a powered mechanism for extending and retracting the push plate above the forks or platen. A powered gripping jaw mechanism attached to the bottom of the push plate grips a free edge of a loaded slip sheet for pulling it onto the platen or wide forks.

A forklift truck equipped with a push-pull attachment and wide forks for handling slip sheets as described is shown, for example, in Brudi U.S. Pat. No. 3,640,414. Low-lift, walkie-type vehicles normally used for handling pallets but adapted to handling slip sheets by the addition of wide forks or platens and push-pull mechanisms are shown, for example, in Rocco U.S. Pat. No. 4,065,012, Olson U.S. Pat. No. 4,274,794 and Frees U.S. Pat. No. 4,300,867.

The primary drawback of the described slip sheet attachments for forklift trucks is that they require the removal of the conventional narrow lift truck forks and their replacement with wide forks or platens and the addition of the push-pull assembly. This is both laborious and time-consuming, especially in the many warehouses, shipping terminals, distribution centers, and other facilities that must be equipped to handle both slip-sheeted and palletized loads. In such facilities, either the conversion of a truck from slip sheets to pallets or vice versa must occur repeatedly, resulting in lost time, or the facility must purchase additional vehicles and equip them for handling only pallets or only slip sheets. Both solutions are undesirable because ultimately they are costly. The problems in converting low-lift vehicles from pallet-handling to slip sheet handling are comparable.

Confronted with the foregoing dilemma, others have developed slip sheet handling attachments which can be quickly attached to and detached from forklift trucks and low-lift vehicles while the conventional narrow pallet-handling forks remain on the vehicle.

One such attachment for a forklift truck has been developed and marketed by DF Industries, Inc., of Alpharetaa, Ga. (DF attachment). This unit includes a single wide platen connected to an upright rear frame. The frame mounts a push-pull assembly including a hydraulically powered horizontal pantograph mechanism which moves a push plate with slip sheet gripping jaws in and out over the platen. The entire unit rests on and is fully supported on the upper surfaces of the conventional narrow forks. The rear frame connects directly to the forks by connecting pins which extend behind the upright portions of the fork heels to retain the attachment on the truck. The DF attachment has a self-contained hydraulic power unit which draws electric power from the lift truck. The attachment is quite lightweight, being made mostly of aluminum, but because of this is vulnerable to damage from the abuse to which such attachments are commonly subjected in normal industrial use.

One version of the DF attachment is adapted for mountin on a walkie or hand jack. This version adds to the forklift version a powered push-pull cylinder which connects the entire unit to the low-lift vehicle frame so that the entire unit, including push-pull frame and platen, can extend and retract on the conventional forks of such vehicles. When extended, the platen tips down to ground level to enable the gripping jaws of the push plate to grip a ground-level slip sheet and pull it onto the platen, after which retraction of the push-pull cylinder pulls the unit onto the forks.

More recently, Cascade Corporation of Portland, Oreg., has also marketed a push-pull slip sheet attachment (Cascade attachment) which can be mounted on a forklift truck without removing the conventional narrow pallet forks. An attachment substantially similar to the Cascade attachment as marketed is shown in Farmer, et al. U.S. Pat. No. 4,482,286 (Farmer patent), and unless otherwise noted, both are referred to herein as the Cascade attachment. Rather than connecting directly to the forks of a lift truck as in the DF attachment, the attachment of the Farmer patent connects to the lower cross bar, and the Cascade attachment as marketed connects to both the upper and lower cross bars, of an Industrial Truck Association (ITA) standardized lift truck carriage.

The Cascade attachment has dual platens, which, like the single platen of the DF attachment, are vertically supported on the forks, at least when the platens are loaded. The rear frame of the Cascade attachment nests between the fork uprights, rather than in front of them as in the DF attachment. The Cascade attachment, unlike the DF attachment, does not have a self-contained hydraulic power unit. Instead, like other push-pull attachments, it takes its hydraulic power from the lift truck through hydraulic hoses, which supply a pair of push-pull cylinders and a pair of gripping jaw cylinders on the attachment. As a result of these and other refinements, the Cascade attachment with its push-pull assembly fully retracted, has substantially less fore and aft bulk or thickness than the DF attachment, and a center of gravity closer to the front wheels of a connected truck. Nevertheless, the Cascade attachment is considerably heavier than the DF attachment, primarily because of its nearly all-steel construction and its heavy frame design.

One of the great concerns with any lift truck attachment is the extent to which it reduces the net load capacity of the lift truck on which it is used. The rated load capacity of most lift trucks is based on use of the truck with conventional narrow forks. It is measured as that load which the truck can handle at a distance of 24 inches from the outwardly facing surface of the fork upright portions with the conventional forks attached to the carriage. Generally, when an attachment which is heavier than the conventional forks replaces those forks on a lift truck, the net load capacity of the truck is reduced. Similarly, when an attachment is added to a lift truck on top of the forks, the added weight of the attachment reduces the net load capacity of the truck.

Typically, lift truck attachments, because of their bulk, also reduce the net load capacity of a lift truck by shifting the center of gravity of a load carried by the truck forward from where it would be if handled solely by the truck's conventional forks. This center of gravity-shifting of the load by the attachment is referred to in the industry as the "lost load" or "effective thickness."

Accordingly, three characteristics of an attachment reduce the rated net load capacity of a forklift truck. These are (1) its weight; (2) the location of its center of gravity or mass; and (3) its lost load or effective thickness. Good attachment design dictates that all three of these factors be minimized to keep the fork truck net capacity with the attachment as close as possible to the net capacity of the truck without the attachment. A major disadvantage of the prior fork-supported push-pull attachments described is that they reduce to an undesirable extent the net load capacity of a lift truck, either because they are too heavy or because they have large lost loads.

An additional problem can arise in the use of fork-supported push-pull attachments which use top hooks to connect the attachment to the upper cross bar of the ITA carriage of a lift truck, a common practice. The upright rear frame of the attachment is generally at right angles to the platens, and the top hooks mount the rear frame against the face of the ITA carriage. As a result, the platens will not seat fully on the forks when unloaded unless the upright and horizontal tine portions of both forks also meet at right angles. However, forks typically become bent in use so that their upright and tine portions meet at greater than 90°. Also, the two forks on a truck usually define different angles. To further complicate the problem, the tines of some forks have top-surface tapers instead of the usual bottom-surface taper from heel to tip, in which case their initial inside angles are greater than 90°.

Placing the foregoing in perspective, a 1° top taper or bend deviation from 90° on a 42 inch fork tine can result in a ¾ inch gap between the fork tip and bottom of the platen. This leads to practical problems for the lift truck operator in handling loads. For example, a typical use of a push-pull attachment is to insert the platen between stacked loads and pull the top load onto the platens. A gap between the fork tip and platen complicates and slows this procedure for the lift truck operator and causes bottom load damage from the forks if care is not exercised, placing an undesirable burden on the operator.

Another problem in the use of prior fork-supported slip sheet handling attachments is the permanent bending of the platens that can occur with the thin steel platens typically used. Such attachments usually have thin platens to save weight, relying on the underlying forks to provide the necessary stiffness to handle loads. However, the forks alone have been inadequate to this task because the platens usually extend beyond the tips of the forks a substantial distance and also laterally well beyond the forks in one or both directions. Thus, the platens are typically weak in bending, especially near their tips. Lift truck operators, using such attachments in scooping under loads, often attempt to lift a load at the unsupported tips of the thin platens, causing the platens to take a permanent set. To avoid such bending problems, thicker platens have been used, but this adds undesirable weight to the attachment and shifts the center of gravity further forward from the carriage, thereby further reducing the net load capacity of the lift truck.

One version of the DF attachment incidentally avoids most platen bending problems through the use of fork-receiving pockets on the underside of the platens. The primary purpose of such fork pockets is to mount the attachment on the forks rather than on the ITA carriage. However, because of the wide variation in the size and shape of forks commonly in use, fork pockets cannot be designed to accomodate all such forks without adding excessive weight to the attachment.

A disadvantage of prior fork-supported push-pull attachments of the type shown in the Farmer patent is that they can be attached only to lift trucks equipped with ITA lift carriages characterized by the types of upper and lower fork-connecting cross bars shown in such patent. The forks for an ITA carriage have hooks which hook to the upper and lower cross bars of the carriage. Other attachments, including push-pull attachments, for such a carriage typically include similar hooks for the same purpose. However, many forklift trucks, especially older ones, do not use ITA lift carriages to connect the forks to the truck. Instead, they use so-called "pin-type" carriages whereby the forks are pivoted relative to the carriage on a pin or shaft. Such carriages do not have the equivalent of the ITA cross bars and therefore do not accept forks or other attachments having hook-type connectors. Accordingly, attachments of the type shown in the Farmer patent cannot be used on a lift truck with a pin-type carriage.

Although an attachment of the DF type can be mounted on lift trucks having both ITA and pin-type carriages because the DF attachments connect to the forks not the carriage, the DF pin-type connector for this purpose has some serious disadvantages. When a DF type attachment is fitted to pin-type forks of a lift truck having a tilt mechanism, the attachment must be spaced a substantial distance in front of the fork uprights to clear the tilt mechanism. This spacing is accomplished by spacer bolts on the frame. These same spacer bolts are used to snug the fork connecting pins against the backs of the forks on both ITA and pin-type carriages, both of which commonly carry forks of different thicknesses. The use of such spacers increases the lost load of the attachment, reducing the net load capacity of the truck. Such spacers also require the use of tools to make the adjustment, which is especially disadvantageous in those facilities in which unions require mechanics to make equipment adjustments when tools are required. The use of both a mechanic and a forklift truck driver to connect and disconnect attachments from lift trucks is inefficient.

The connecting means for connecting prior fork-supported attachments to lift trucks have been subject to damage and breakage under normal industrial use. One problem is that the quick-connect elements of such connecting means have been located in close proximity to the forks, subjecting them to fork impact as the operator attempts to insert the forks beneath the platens during installation of the attachment on a truck. Some such connecting means have also included elements which become broken or damaged by catching on cracks or floor protrusions such as loading ramps as the fork truck is driven over them with the load positioned close to the floor as is commonly done for safety.

Prior fork-supported push-pull attachments are not self-supporting in a stable free-standing position on a level ground surface when detached from a lift truck such that the forks of a lift truck can be inserted beneath and withdrawn from beneath the attachment while in such position. For example, in the attachment of the Farmer patent, a pivoting hook-type connector swings down and forward to a frame support position extending below the lower limits of the forks so that, theoretically, the lower connecting hooks and tips of the platens support the attachment in a free-standing position on level ground when detached from a lift truck. However, when thus supported with its push-pull mechanism retracted, the attachment is unstable because its center of gravity is so far above the platens and so close to the rear of the attachment in relation to the rear support point provided by the hooks that the attachment will tend to tip over backward with a small push in that direction. This is obviously undesirable for safety and other reasons in an industrial environment.

Although the center of gravity of such an attachment might be shifted forward by extending the push plate when the attachment is free-standing, this solution tends to bend the platens making it difficult to insert the forks under the attachment for installation. There is also the possibility that lift truck operators would forget to extend the push plate when detaching the unit from a truck. In practice, the instability problem has been solved by elevating the attachment on a large wood block or frame rather than setting it directly on the floor. In an industrial environment, this is an inconvenience because the block can get misplaced, the attachment must be deposited in a designated area where the blocks are located, and the block raises the sharp platen tips several inches off the floor, which is also unsafe. The foregoing instability problems are increased if the platens are detached from the frame with the attachment in a free-standing mode.

Accordingly, there is still a need for a quick-mounting fork-supported slip sheet handling attachment for a forklift truck which (a) minimizes the reduction in rated load capacity of the truck; (b) is easily adaptable for connection to trucks having both ITA and pin-type lift carriages; (c) has quick-connect means capable of withstanding the rigors of industrial use with all types of forks in common use; (d) has platens that are lightweight yet strong to resist permanent bending under normal industrial use; (e) is stable in a self-supporting, free-standing mode with or without the platens and irrespective of push plate position; and (f) can easily be attached to a lift truck from its free-standing position.

Primary objectives of the present invention, therefore, are to provide a new and improved fork-supported slip sheet handling attachment for a forklift truck that:

(1) minimizes reduction in the rated net load capacity of the truck by being lightweight and having a minimum lost load or effective thickness;

(2) is adapted for connection to lift trucks having both pin-type and ITA-type fork carriages and forks of different sizes and shapes;

(3) is quickly and easily attachable to and detachable from the forklift truck;

(4) is easy to mount on and remove from the forks of a lift truck with the truck operator at his controls;

(5) is self-supporting in an elevated free-standing mode when removed from a lift truck to facilitate its rapid mounting on and removal from the forks of a lift truck with the truck operator at his controls; and (6) is stable when in its free-standing mode, even with its platens removed; and (7) is strong and durable despite its light weight.

SUMMARY OF THE INVENTION

The foregoing objectives are carried out in the present invention by providing a fork-mounted slip sheet handling attachment for a forklift truck having one or more of the following features:

(1) a lightweight but strong upright space-type base frame characterized by an open flexible framework including a pair of upright, transversely spaced apart side frame members which can be interconnected by a single cross frame member.

(2) a base frame in which the principal cross frame member can also function as a connecting member for connecting a push-pull assembly to the frame;

(3) a load-engaging platen means which also structurally interconnects the lower ends of the upright side frame members to strengthen and help stiffen the open framework of the base frame;

(4) a base frame with side frame members which extend outside the forks and straddle the fork uprights on an ITA-type carriage to enable some lateral adjustment of the forks inwardly of the side frame members and centering of them beneath the platens for optimum underlying fork-support for the platen means;

(5) a base frame with upright frame members which have forwardly projecting continuations at their lower ends underlying the platen means to secure the platen means to the base frame;

(6) a fork-connecting means carried by the base frame for connecting the frame to the fork upright portions, with the fork-engaging surfaces of the connecting means moving in a reference plane of the rear surfaces of the fork uprights to adapt the attachment for mounting to forks of different thickness, heel bend and ITA hook configurations and to either pin-type or ITA-type forks;

(7) a base frame, platen means and fork-connecting means which cooperate to make the attachment lie reasonably flat on the top load supporting surfaces of typical industrial forks, even though such surfaces may intersect their respective fork upright portions at different angles and at greater than 90 degrees;

(8) a base frame support means for supporting the base frame of the attachment in a stable, elevated, free-standing position on a reasonably flat, level floor when removed from a lift truck, to facilitate mounting of the attachment on and its removal from the truck;

(9) a frame support means as aforesaid which is movable in conjunction with the fork-connecting means of the attachment in the aforementioned reference plane between active and inactive positions so that movement of the connecting means to its fork-engaging position moves the frame support means to its inactive position and vise versa;

(10) a frame support means as aforesaid which in its active frame-supporting position has a frame-supporting portion extending rearwardly of the aforementioned reference plane for optimum stability when the frame is in its free-standing position;

(11) a frame support means as aforesaid which cooperates with the aforementioned forward continuations of the side frame members to provide a stable support for the base frame even with the platen means removed from the frame; and

(12) a locking means, which may include a vernier adjustment feature, for securely locking the fork-connecting means and frame support means in their active and inactive positions regardless of variations in fork thickness, fork heel configuration and ITA fork hook configuration;

(13) a platen stiffening means which cooperates with the two side frame members to stiffen the platens and which can be added as required to suitably stiffen the platens and minimize the possiblity of permanent platen bending when lifting loads on the tips of the platens;

(14) a single or dual platen construction which incorporates a central spacer means interconnecting the platens in a manner such that in cooperation with the base frame, the platens have sufficient lateral stiffness to resist permanent deformation from high impact side forces; and

(15) a single push-pull cylinder as part of the push-pull mechanism, which simplifies the mechanism and saves weight.

The foregoing and other objects, features and advantages of the present invention will become more apparent from the following detailed description which proceeds with reference to the accompanying drawings.

DETAILED DESCRIPTION OF A PREFERRED EMBODIMENT

(a) general arrangement

Figure 1:
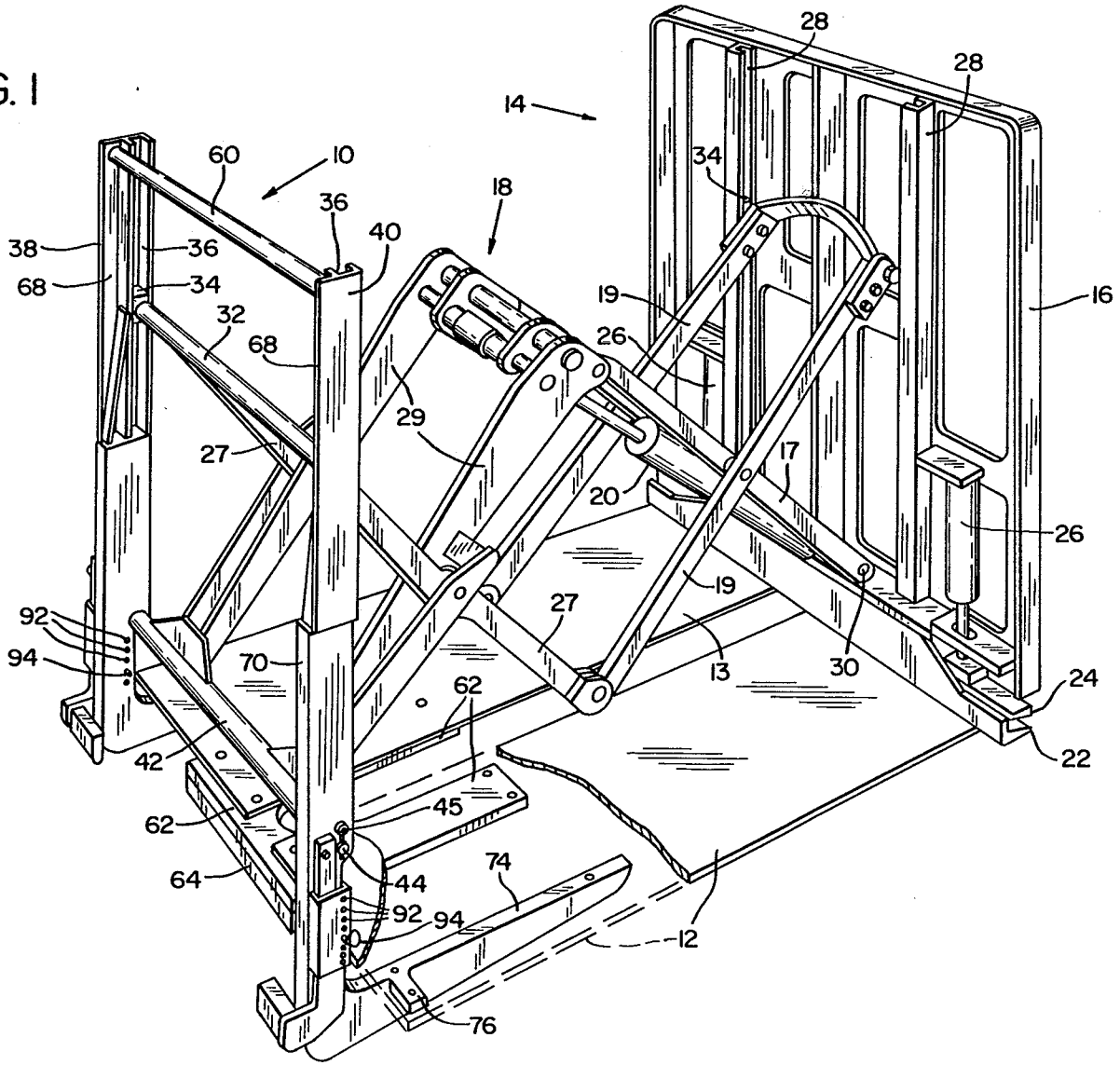
FIG. 1 is a perspective view of an attachment in accordance with the invention as viewed from the rear and above the attachment, with the push plate fully extended.

Referring first to FIG. 1 of the drawings, what is now a preferred embodiment of the attachment of the present invention includes an upright base frame, indicated generally at 10, mounting at its lower end a platen means comprising a pair of thin plate-like platens 12, 13 and a yoke-like spacer plate 62 extending forwardly of base frame 10. Above the platen means the base frame mounts a push-pull assembly indicated generally at 14.

Figure 8:
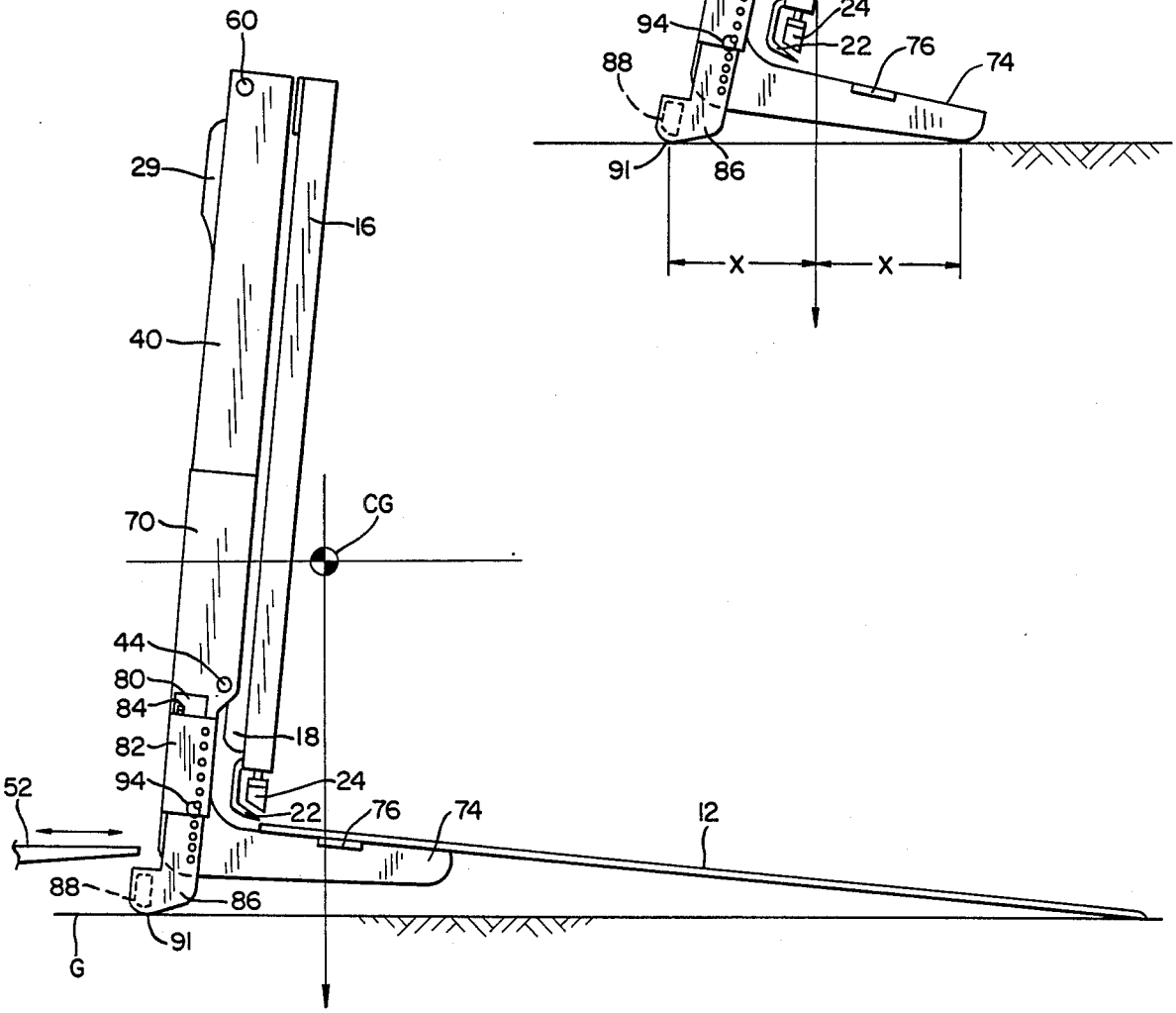
FIG. 8 is a side elevational view of the full attachment in its self-supporting free-standing mode and with its push-pull mechanism retracted.

The push-pull assembly includes an upright push plate 16 connected to the base frame by a powered lazy tong or pantograph linkage mechanism 18 for extending and retracting the push plate 16 over the platens from a retracted position adjacent the base frame as shown in FIG. 8 to an extended position adjacent the tips of the platens as shown in FIG. 1. The pantograph mechanism includes a single fluid power actuating cylinder 20 for extending and retracting the mechanism and thus the push plate 16. Although a pair of actuating cylinders could be used, the single cylinder 20 is preferred because it simplifies the pantograph linkage and the power distribution and control means (not shown), with resultant savings in weight and cost.

The lower edge portion of the push plate carries a gripper jaw means, including a stationary lower gripper jaw 22 and a vertically movable upper gripping bar 24. The gripper bar 24 is operated by a pair of vertically disposed fluid power cylinders 26 and coacts with the gripper jaw 22 for selectively gripping and releasing a free edge of a slip sheet in a well-known manner.

The pantograph cylinder 20 and gripper jaw cylinders are typically powered by a source of pressure fluid on a connected lift truck through appropriate quick-coupled hydraulic hoses on the truck and attachment (not shown) in a well-known manner. Alternatively, the pantograph and jaw actuating means 26 can be electric actuators which draw electric power from the lift truck, also in a well-known manner.

The pantograph mechanism and gripper jaw means are of conventional construction, well-known in the industry and are generally described in Brudi U.S. Pat. No. 3,640,414. Briefly, the forward ends of the two front regulator arms 19 of the pantograph mechanism ride up and down on low-friction slides 34 in upright guide channels 28 of the push plate 16 while two front push-pull arms 17 (only one being shown in FIG. 1) are pivoted at points 30 to lower portions of push plate 16. Similarly, the rear ends of two rear regulator arms 27 are connected to a cross bar 32 which rides on low friction slides 34 in guide channels 36 of the side frame members 38, 40 of the base frame. A pair of rear push-pull arms 29 are fixed to a spreader tube 42 which pivots on a cross frame shaft 44. Shaft 44 extends between and is secured to the transversely spaced side frame members 38, 40 by keeper pins 45 on both ends of the shaft. Thus, shaft 44 pivotally connects the rear push-pull arms 29 to the base frame.

In FIGS. 2–3 and 5–7, the described attachment is shown mounted on a forklift truck of a conventional type having a forwardly and rearwardly tiltable mast (not shown) mounting a lift carriage 46 which travels up and down on the mast. The carriage mounts an upper cross bar 48 having an upward projection 49 along its upper edge and a lower cross bar 50 having a downward projection 51 along its lower edge. These cross bars and the profile of the projections are configured, sized and spaced according to ITA standardization guidelines, and are referred to hereinafter as ITA bars and its carriage as an ITA carriage.

Figure 3:
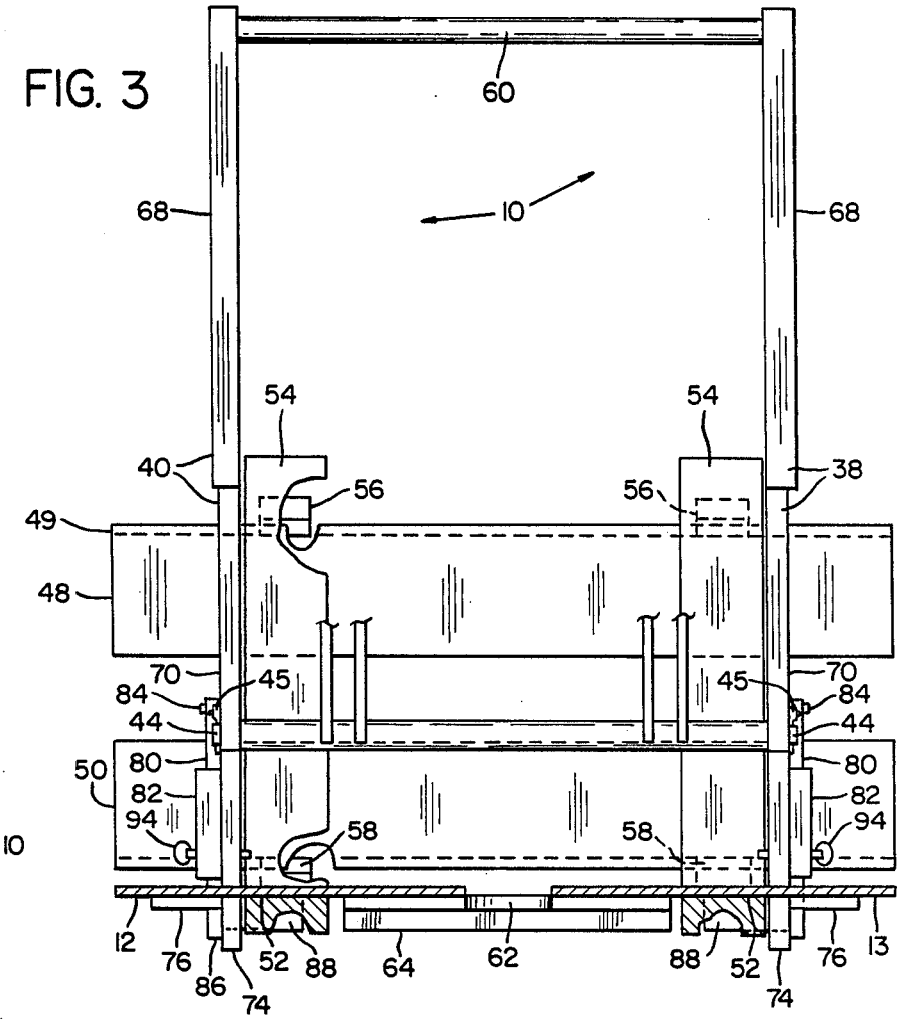
FIG. 3 is a front elevational view of the base frame portion of the attachment shown connected to the same lift truck as in FIG. 2, with the push-pull assembly of the attachment removed and the forks and platens sectioned about halfway along their length.
Figure 2:
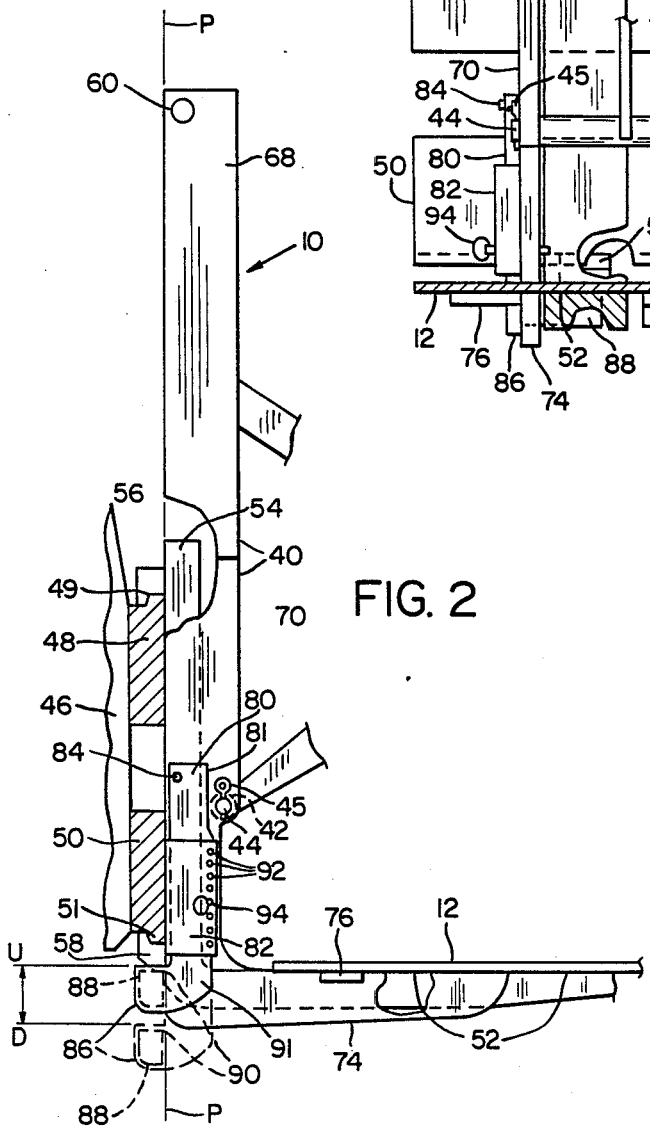
FIG. 2 is a side elevational view of the attachment of FIG. 1 on a lift truck with an ITA carriage and with the push-pull assembly of the attachment removed.

As best shown in FIGS. 2 and 3, a pair of typical, relatively narrow, pallet handling load-lifting forks 52 are mounted on the ITA carriage cross bars in a well-known manner. Such forks are generally right angular in shape, including generally horizontal load-engaging portions 53 and upright fork portions 54. The upright portions have integral downwardly projecting upper hooks 56 and integral upwardly projecting lower hooks 58 on their rear surfaces which interengage the upper and lower ITA bars, respectively, to secure the forks to the carriage in a well-known manner.

Attachments other than the conventional narrow pallet forks 52 shown are commonly attached to the ITA bars of a lift carriage in the same manner as the forks or with quick lock-unlock bottom hooks. However, as best shown in FIGS. 2 and 3, the preferred embodiment of the present invention, unlike most slip sheet and other attachments, mounts on, is always fully supported on, and connects directly and firmly to, the conventional narrow lift truck forks 52 rather than to the ITA bars, adapting the attachment to be used readily with lift trucks having carriages which are not of the ITA type. These unique features adapt the attachment to any type fork lift truck and user preference. Because the forks are used to support the platens under load, the platens can be made of thin, lightweight sheets of material and need not have the inherent rigidity and therefore weight to support a load by themselves. Instead, the forks retain their full load-supporting function and transmit all loads to be handled by the lift truck directly to the lift carriage.

(b) base frame and platen assembly

The attachment is of substantially lighter weight than past and currently available attachments of its type without sacrificing strength, durability and rated load handling capacity. For example, a prototype of the attachment has been designed and successfully tested for a rated load capacity of 4,500 lbs. Previous attachments of its type and comparable size have had rated capacities of only 3,000 lbs. This attribute is achieved primarily by its unique base frame construction. The base frame, best shown in FIGS. 1–4, is an open framework defined by thin transversely spaced apart upright side frame members 38, 40, interconnected by a cross frame shaft 44 (inside the tube 42). Shaft 44 extends through and is secured to lower side frame portions 70 by keeper pins 45 at both ends. The keeper pins are rigidly fixed to lower side frame portions 70 by bolts or other suitable means. Thus shaft 44, in cooperation with keeper pins 45, keeps the side frame members parallel in all planes. Included in this embodiment is a top cross frame member 60 which can be pinned or otherwise connected to side frame members 38, 40.

Figure 5:
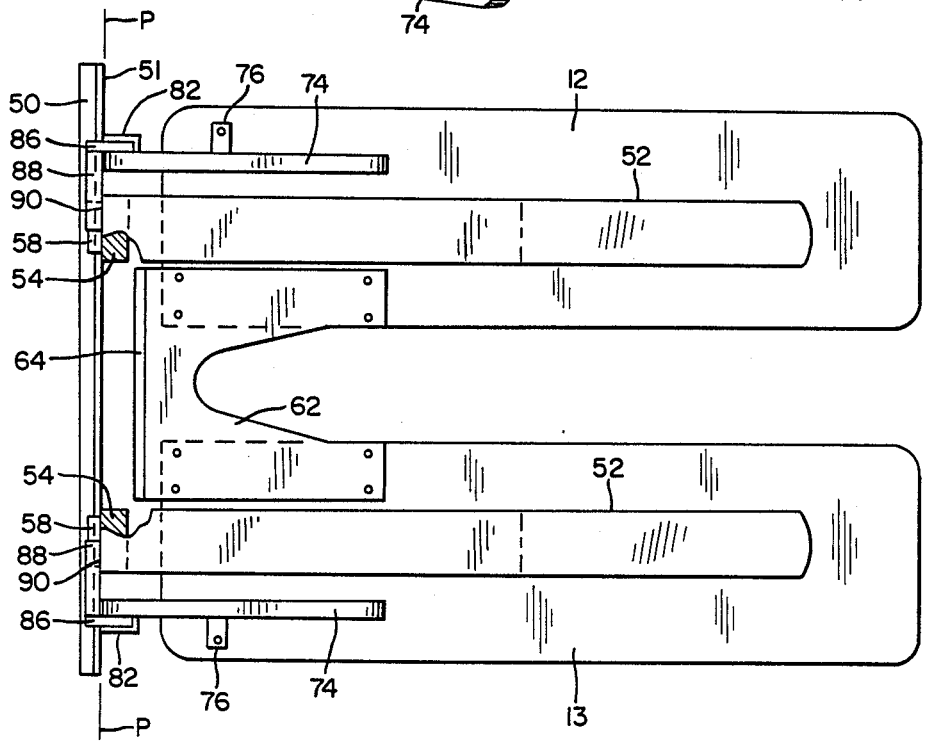
FIG. 5 is a bottom plan view of the attachment connected to an ITA carriage.

Lending generally compliant stiffness to the base frame at its lower end is the platen means, including the two thin platens 12, 13 joined by the thicker spacer plate 62 at their inner rear ends. The spacer plate is not connected directly to the base frame 10 and does not protrude between the fork uprights 54 or side frame portions 70, as shown in FIG. 5. Instead, it is simply connected to the two platens 12, 13, serving as a spacer and stiffener to maintain a desired spacing, rigidity and horizontal flatness therebetween while adding minimal weight to the attachment. Plate 62 may be connected to the underside of platens 12, 13 by threaded fasteners, by welding, or by other suitable means. A rectangular bar or restrictor plate 64 depending from the underside of spacer plate 62 at its rear end serves as a visual aid or guide means to the forklift operator when inserting the forks beneath the platens and prevents fork insertion beneath the platens in that region which, if permitted, could cause improper mounting of the attachment on the forks.

Figures 10, 11:
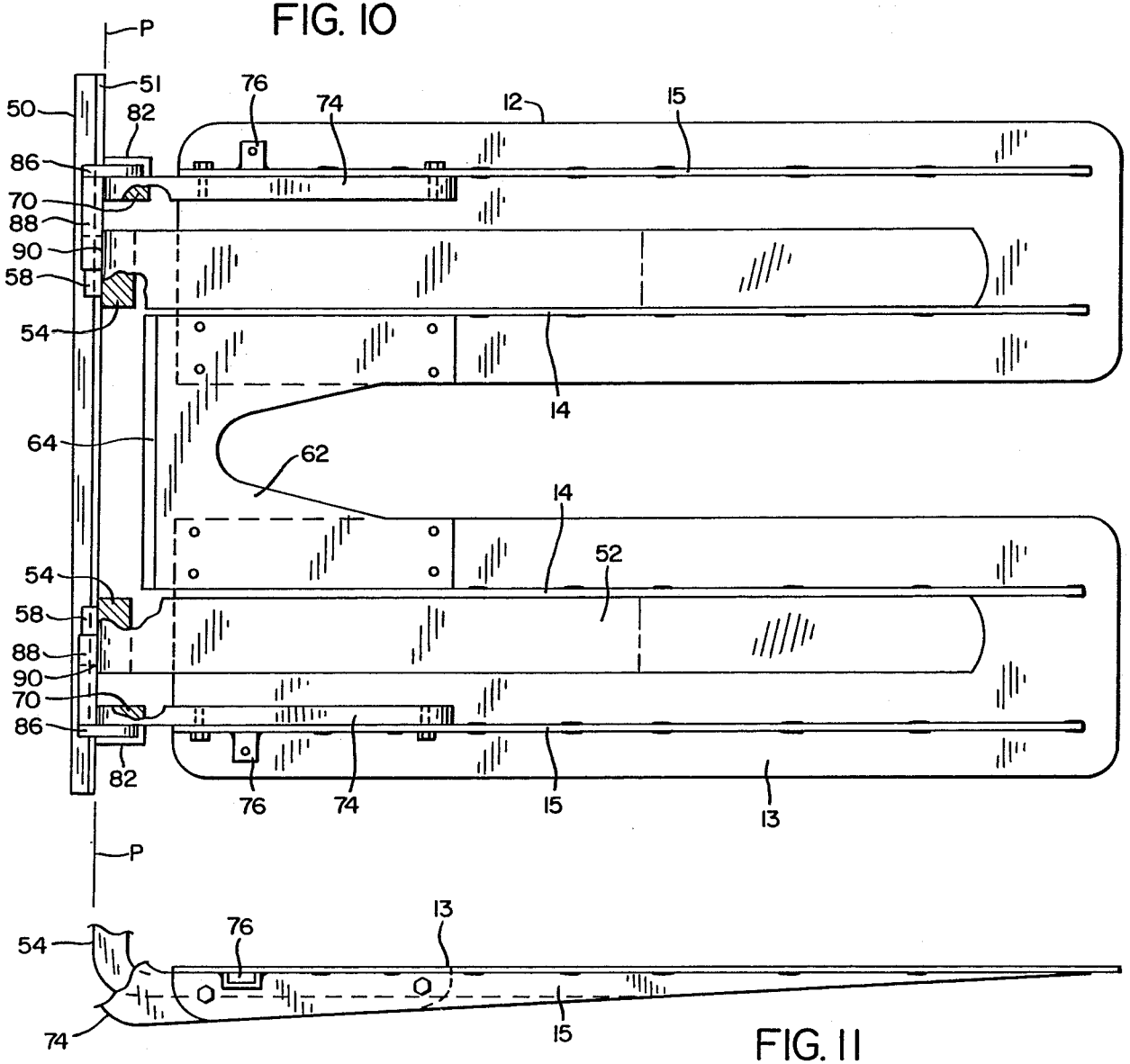
FIG. 10 is a view similar to FIG. 5, but showing a modified platen construction.
FIG. 11 is a side elevation of the platen construction shown in FIG. 10.

If additional stiffening of the inner margins of the platens is required, especially near their outer ends, so as to increase the load capacity of the attachment, the shape of plate 62 can be modified as shown in FIGS. 10 and 11. Stiffening ribs 65 are affixed to the outer edges of plate 62 and extend parallel to the longitudinal axis of the platens. Similarly, the outer margins of the platens can be stiffened by attaching ribs 66 to side frame portions 74. These stiffeners can be of rectangular cross section wedge-shaped pieces, as shown, or of other appropriate shapes. They can be affixed to the platens by welding as shown, by bolting, or by other appropriate means.

Instead of the two platens 12, 13, the attachment can be equipped with a single thin, wide platen, in which case plate 62 would still be attached and retained beneath the single platen in the position shown in FIGS. 1 and 5.

Each side frame member 38, 40 includes a thin, lightweight, fabricated upper section 68, which forms the guide channels 36 for the pantograph cross bar slides 34. Upper section 68 is welded to the stronger, solid rectangular lower section 70 mounting the pantograph pivot shaft 44.

Lower sections 70 include forwardly projecting continuations or ribs 74 at their lower ends which mount the platens to the frame. Ribs 74 project beneath platens 12, 13 laterally outwardly of forks 52 (see FIG. 5), which support the platen means by engaging the platens between stiffening ribs 74 and stiffening plate 62. The platens are connected to the upper surfaces of ribs 74 by threaded fasteners, welding, or other appropriate attachment means. Each rib includes a laterally outwardly projecting support portion 76 to provide additional lateral stiffening of the platens.

Figure 4:
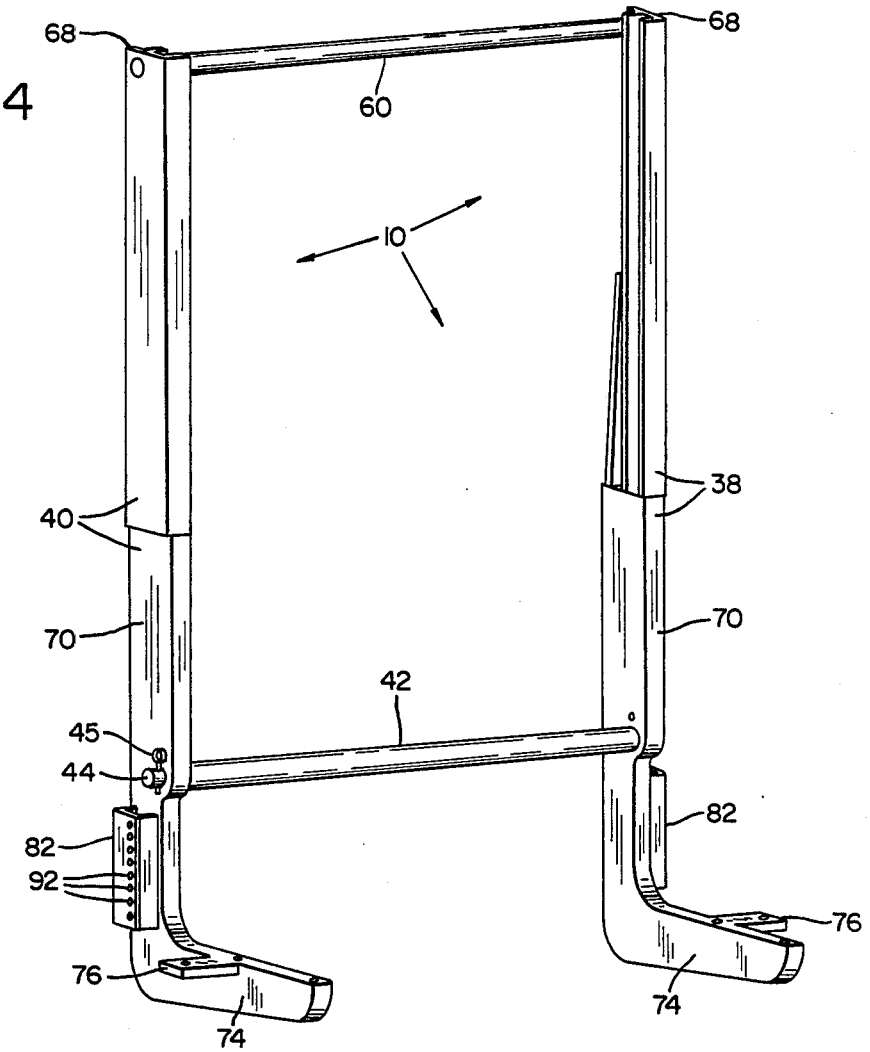
FIG. 4 is an enlarged perspective view of the base frame portion of the attachment.

As most apparent from FIGS. 3–5, ribs 74 provide the only means of fastening the entire platen means to the frame. The frame and its connected platen means, however, are fully supported vertically on the upper load-supporting surfaces of forks 52. Therefore all platen loads are transmitted directly to the forks and thence to the lift carriage 46. In short, the loads cannot be transmitted to the carriage except through the forks. Although stiffening plate 62 serves as a platen spacer and has an important platen stiffening function, it does not connect the platens to the frame and is not itself connected to the frame except through the platens.

The platen means and frame cooperate to form a unique, light, flexible but strong space frame structure. The upright members of this structure are the two side frame members 38, 40. The primary transverse members of this space frame structure are the platen means 12, 13, 62 as a unit acting as one cross member and the cross frame shaft 44 working with keeper pins 45 as a second cross member. Top cross member 60 of the frame is a redundant submember of such space frame with either one of the two mentioned primary cross members and therefore need not be rigidly attached to the side frame members 38, 40. The only purpose of cross membrr 60 is to maintain the two side frame members 38, 40 parallel when shaft 44 and pantograph mechanism 18 are not attached to the side frame members.

The compliant and flexible nature of the described space frame structure allows the platen means to seat on and conform to a wide range of new or used forks on new or old forklift trucks. When new, a fork usually forms an angle of 90° between the upper surface of its generally horizontal load-supporting tine portion 53 and its upright shank portion 54. Further, the horizontal fork portions 53 are generally 90° to the face of the carriage ITA bars and parallel to each other. After typical use, however, this is rarely the case. Yet ideally the platens should lie directly on the fork load support surfaces with no appreciable gap. With the flexible and compliant nature of the space frame described and the manner by which it is connected to the truck, the platens will accommodate a wide range of fork conditions and geometries and still seat on the forks with minimal gaps. Further, because of the torsion bar effect of the platen means, the space frame assembly has been found from tests to be capable of absorbing and dissipating energy from high-velocity direct impacts with the platen means at various angles without structural deformation.

Figure 9:
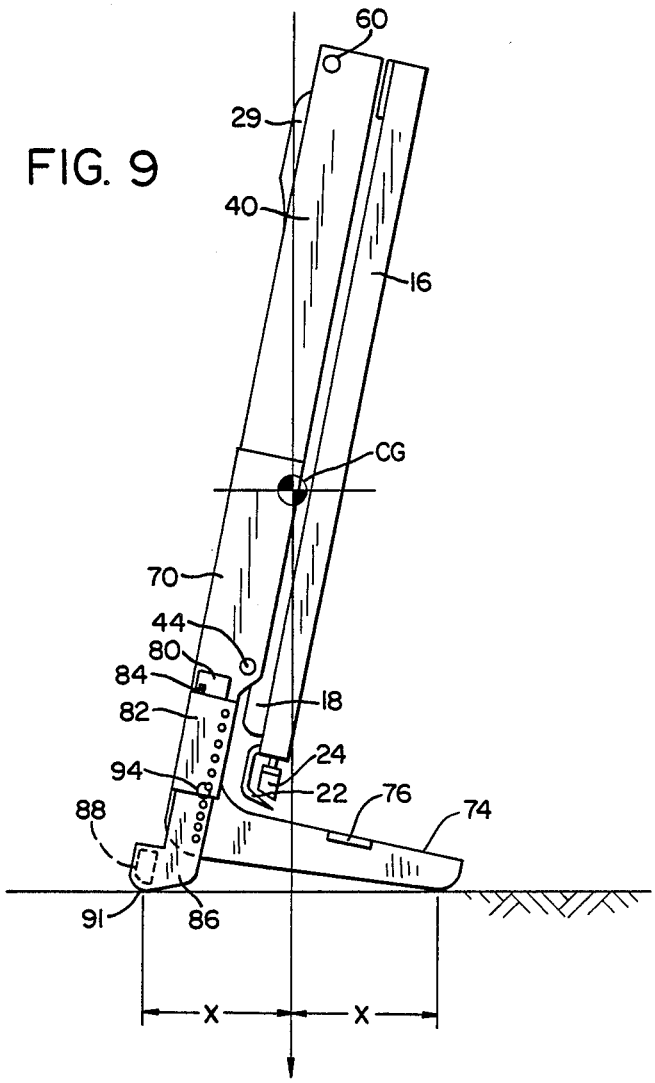
FIG. 9 is a view similar to FIG. 8 but with the platen means removed from the attachment.

As shown in FIG. 2, each lower side frame portion 70, where it curves to form rib 74, is substantially thicker than the corresponding fork 52 at its bend or heel, and therefore provides substantial bending strength at this point, equaling or exceeding that of the forks. Ribs 74 also provide stabilizing supports for the attachment when it is detached from a lift truck and the platens are removed from the ribs, as shown in FIG. 9 and described in more detail shortly. The length of ribs 74 can be varied depending on needs and flex characteristics of the platens. With very flexible platens, the ribs can be lengthened to stiffen forward portions of the platens, as shown in FIG. 10.

It will be most apparent from FIGS. 2 and 3 that the side frame members 38, 40 are relatively wide in a fore and aft direction and laterally thin, enhancing their strength-to-weight ratio and providing the frame with its greatest strength in the direction where it is most needed, that is, in the push-pull direction of the attachment.

The base frame straddles and lies in front of the pair of fork uprights 54 when mounted on a lift truck having an ITA carriage, as best shown in FIGS. 2 and 3. That is, the top cross frame member 60 overlies the fork uprights, the side frame members 38, 40 extend along the outside of such uprights, spreader tube 42 and pivot shaft 44 are in front of such uprights, and the rear surfaces of the side frame members lie substantially in the same vertical plane P (FIG. 2) as the rear surfaces of the fork uprights 54 and the front faces of ITA bars 48, 50 of the lift truck carriage. This nesting of the fork uprights inside the base frame, coupled with the exceptionally lightweight construction of the frame, maximizes the net load capacity of a lift truck with the attachment installed, an important consideration in lift truck attachment design.

As previously noted, the net load capacity of a lift truck with an attachment is a function of the attachment's effective thickness or lost load, its weight, and the location of its center of mass or gravity. Effective thickness is the minimum distance from the lift truck carriage face to the rear face of the load, which under ideal conditions is also the front face of the attachment's push plate when retracted. In this embodiment, this distance depends only on the fore and aft width of the base frame and the thickness of the push plate. Both of these dimensions are minimal in the present attachment. Obviously, the heavier and thicker the attachment and the greater the distance from the truck carriage face to its center of gravity, the less will be the net load capacity of the lift truck with the attachment in place. The present attachment, because of its light weight and small effective thickness, provides a substantially greater net load capacity on a given lift truck than prior fork-mounted slip sheet attachments.

(c) fork-connecting and frame support means

Figure 7:
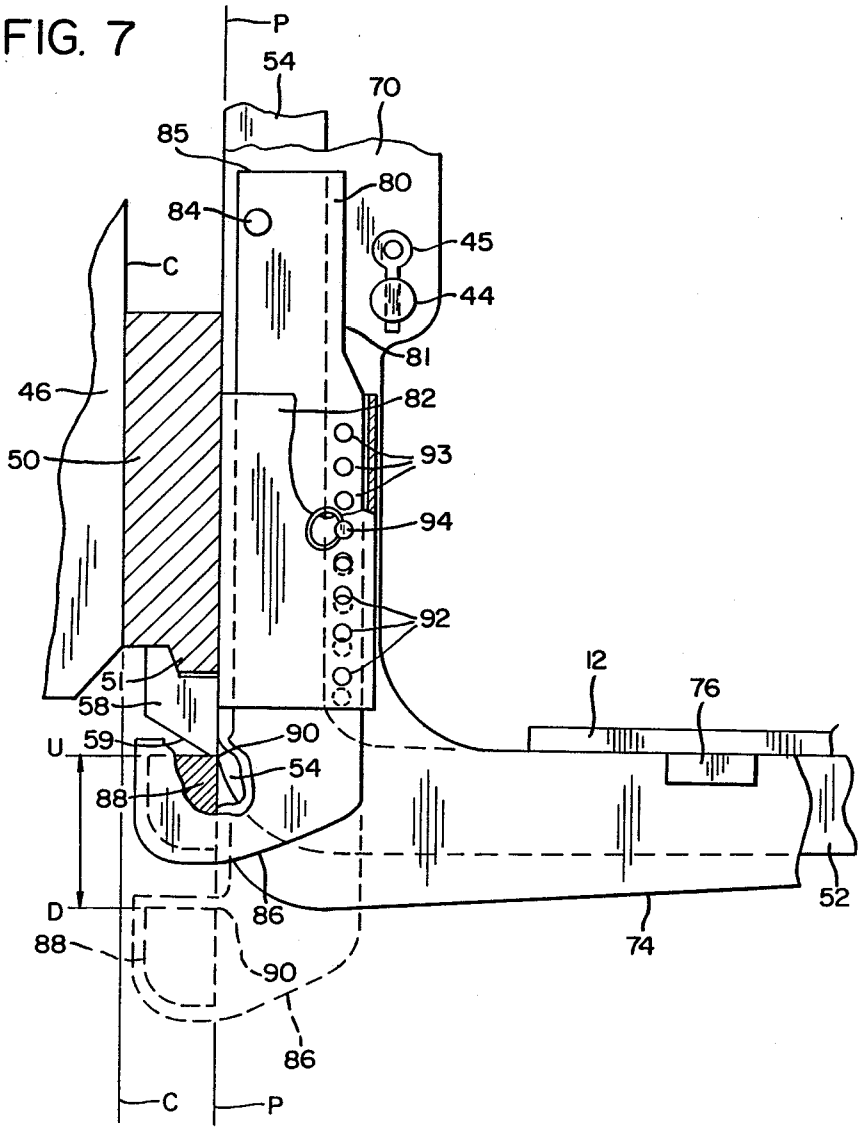
FIG. 7 is an enlarged side elevational view of generally the same lower frame portion of the attachment as shown in FIG. 6.
Figure 6:
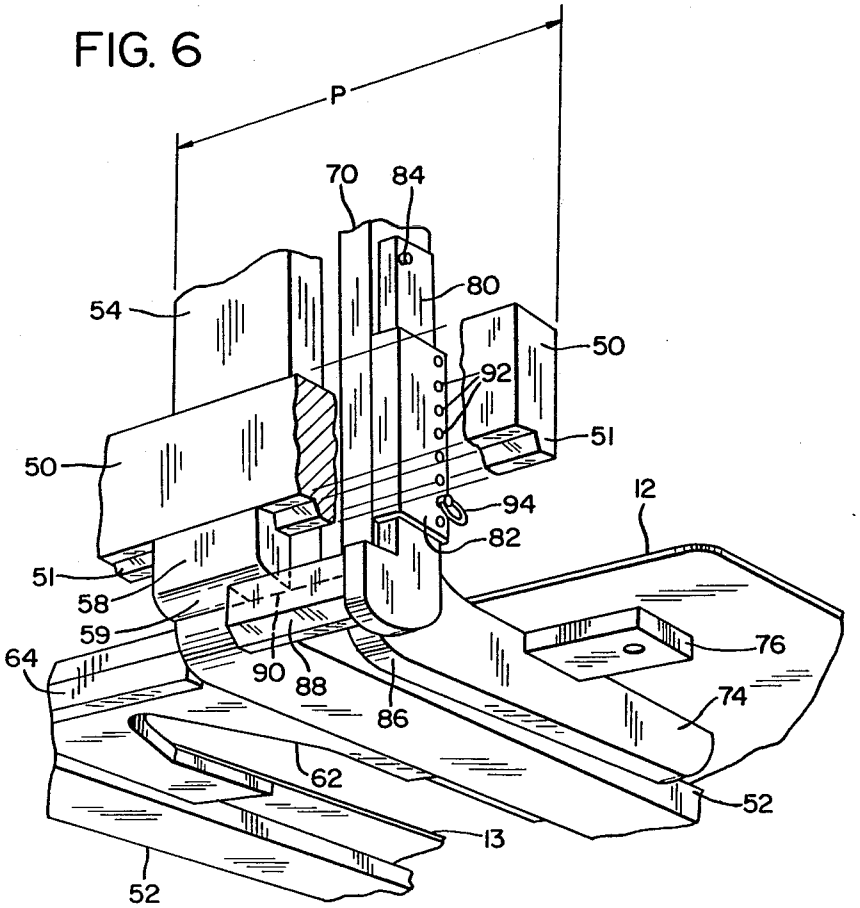
FIG. 6 is an enlarged rear perspective view of a lower frame portion of the attachment shown connected to an ITA carriage.

As best shown in FIGS. 6 and 7, the fork-connecting means of the attachment include fork-engaging means which extend behind the fork uprights 54 and engage the bottom surfaces 59 of the lower fork hooks 58 and rear surfaces of the fork uprights. The fork-connecting means cooperate with the frame lower side portions 70 and platen means to prevent any significant movement of the attachment on the forks in all but the vertical direction. The forks, of course, prevent movement in the vertical direction. In the illustrated embodiment, the connecting means includes a pair of fork connectors, one carried on the outside of each lower side frame portion 70. Each connector includes a J-shaped slide plate 80, slidable vertically along the outside surface of lower side frame portion 70 within a slideway sleeve 82. The upper end of slide plate 80 includes a stop pin 84 which abuts the top of sleeve 82 to limit downward travel of the slide plate.

The lower end of slide plate 80 defines a frame support foot 86. The foot projects rearwardly from reference plane P to provide a means for supporting the rear of the attachment in an elevated self-supporting position with respect to a generally horizontal ground surface G when the attachment is removed from a lift truck, as shown in FIGS. 8 and 9. Projecting laterally inward behind the heel of the fork from the inner surface of foot 86 is a fork-connecting block 88 providing the fork-engaging means. Block 88 has a fork-engaging front edge 90 which is constrained to move in the reference plane P of the rear frame and fork upright surfaces. It moves between a raised fork-engaging position U and a lowered fork-release position D shown in FIG. 7. In position U, edge 90 engages the rear surface of the adjacent fork upright 54 and the lowest surface 59 of the lower fork hook 58. In the lowered fork-release position D, fork-engaging edge 90 is disengaged from the rear surface of the fork and the lower fork hook. In fact, in its lowered position, determined by pin 84 abutting the top of sleeve 82, block 88 is spaced well below the bottom surface of the fork. This enables easy removal of the attachment from the lift truck by simply lifting the fork until its bottom surface clears the top of block 86 and then withdrawing the fork by backing the lift truck. Similarly, as shown in FIG. 8, the attachment when free-standing can easily be engaged by the forks.

As connecting block 88 moves from its fork-engaging position U to its fork-release position D, frame support foot 86 moves from a raised, inactive position to its lowered, frame-supporting position shown in phantom in FIGS. 2 and 7. This feature enables the attachment to be disconnected from the lift truck and conditioned for free-standing self-support with a single manipulation of each connector.

As best shown in FIG. 7, means are provided for locking the fork-connecting block 88 in its fork-engaging and fork-release positions. The same means selectively lock support foot 86 in its inactive and active frame-supporting positions. Such locking means include a row of vertical pin holes 92 extending through each sleeve 82 and corresponding pin holes (not shown) through lower frame section 70 aligned with holes 92. Another corresponding row of pin holes 93 extends through the slide plate 80, but at a slightly different spacing between holes than provided in the associated sleeve 82 and side frame portion 70. This provides, in effect, a vernier-type pin locking feature which employs a quick connect-disconnect ball detent pull pin 94.

To illustrate, in connecting the attachment to a lift truck, slide plate 80 is lifted by hand until the fork-engaging edge 90 of connecting block 88 engages bottom surface 59 of lower fork hook 58 simultaneously with engagement of the rear surface of fork upright 54, which is in plane P. At this point, pull pin 94 is inserted in the one of pin holes 92 which is most nearly aligned with a corresponding pin hole 93 of slide member 80. Similarly, when the attachment is to be released from the truck, pull pin 94 is pulled from its pin hole to release the slide member and drop foot 86 to a frame-supporting position, wherein pin 84 abuts the top of sleeve 82, thereby also releasing fork-connecting block 88 from the fork. Thereafter, pull pin 94 is reinserted in the one of pin holes 92 then aligned with one of the corresponding pin holes 93 in slide plate 80 to lock the support foot in its frame-supporting position and the fork-connecting block 88 in its fork-release position. This vernier-type locking feature thus adapts the fork connector means to forks of different thicknesses and configurations at the fork heel.

Because all movement of the fork-engaging edge 90 of the fork connector block is in the reference plane P of the rear surface of the fork upright and the front surfaces of the ITA bars, it functions independently of fork shape or thickness. Thus, the fork-connecting means is adaptable to forks of widely varying widths, thicknesses, heel curvatures, lower fork hook geometries and hook weld styles. As will be described in more detail shortly, this feature also adapts the attachment for connection to both pin-type forks, shown in FIG. 12, and the ITA forks shown in FIGS. 2, 3, 5, 6 and 7.

Slide plate 80 has several additional notable features. As shown in FIG. 7, the centerline of holes 93 in slide plate 80 is coincident with the centerline of holes 92 in sleeve 82 and with the edge surface 81 of slide plate 80 so that pin 94 cannot be misplaced above the row of holes 93. Without this feature, there would be a multiplicity of holes 92 in which pin 94 could be inserted without slider 80 being locked in its frame support position. Also, top surface 85 of slider 80 provides a hammer striking surface, should the slider become jammed in sleeve 82 for any reason. Foot 86 of the slider is also designed so as not to extend beyond the back plane C of the lower ITA bar to prevent interference with the fork lift carriage 46. The bottom of foot 86, the heel and toe of stiffening rib 74 and the lower back edge of block 88 have generous radii as shown in FIGS. 6 and 7 to allow the attachment to easily ride over truck loading ramp edges, warehouse floor cracks, and other floor obstructions which might otherwise damage the bottom of the attachment or the fork-connecting means.

One important feature of the frame support foot 86 is the stability it gives the attachment when in a free-standing mode removed from the lift truck, as shown in FIGS. 8 and 9. Normally, when the attachment is removed from a truck, foot 86 supports the base frame at a sufficient elevation above the ground support surface G that the forks of a lift truck can be readily inserted beneath the platens 12, 13 for easy mounting and dismounting of the attachment.

When the attachment is in its free-standing position, the base frame is tilted forward slightly, supported at its rear end on the generally lowest portion 91 of the lower edge of the foot and at its forward end by the tips of the platens 12, 13. This provides great stability against tipping in a forward direction, because the composite center of gravity CG of the lightweight attachment is located well forward of point 91 and well behind the tips of the platens. Even when the platens are removed from their supporting frame ribs 74 (FIG. 9), the attachment has good stability in any direction because it rests on the low point 91 of feet 86 and the forward ground contact point 95 of ribs 74, which act as stabilizing outriggers to resist forward tipping. In fact, points 91 and 95 are about equidistant from the projection on ground plane G of center of gravity CG with push plate 16 fully retracted, as indicated by the dimensions X—X in FIG. 9.

Because the center of gravity of the attachment, even with its push-pull assembly retracted, is a substantial distance forwardly of reference plane P, the attachment cannot readily be tipped over in a rearward direction.

(d) pin fork adaptation

Figure 12:
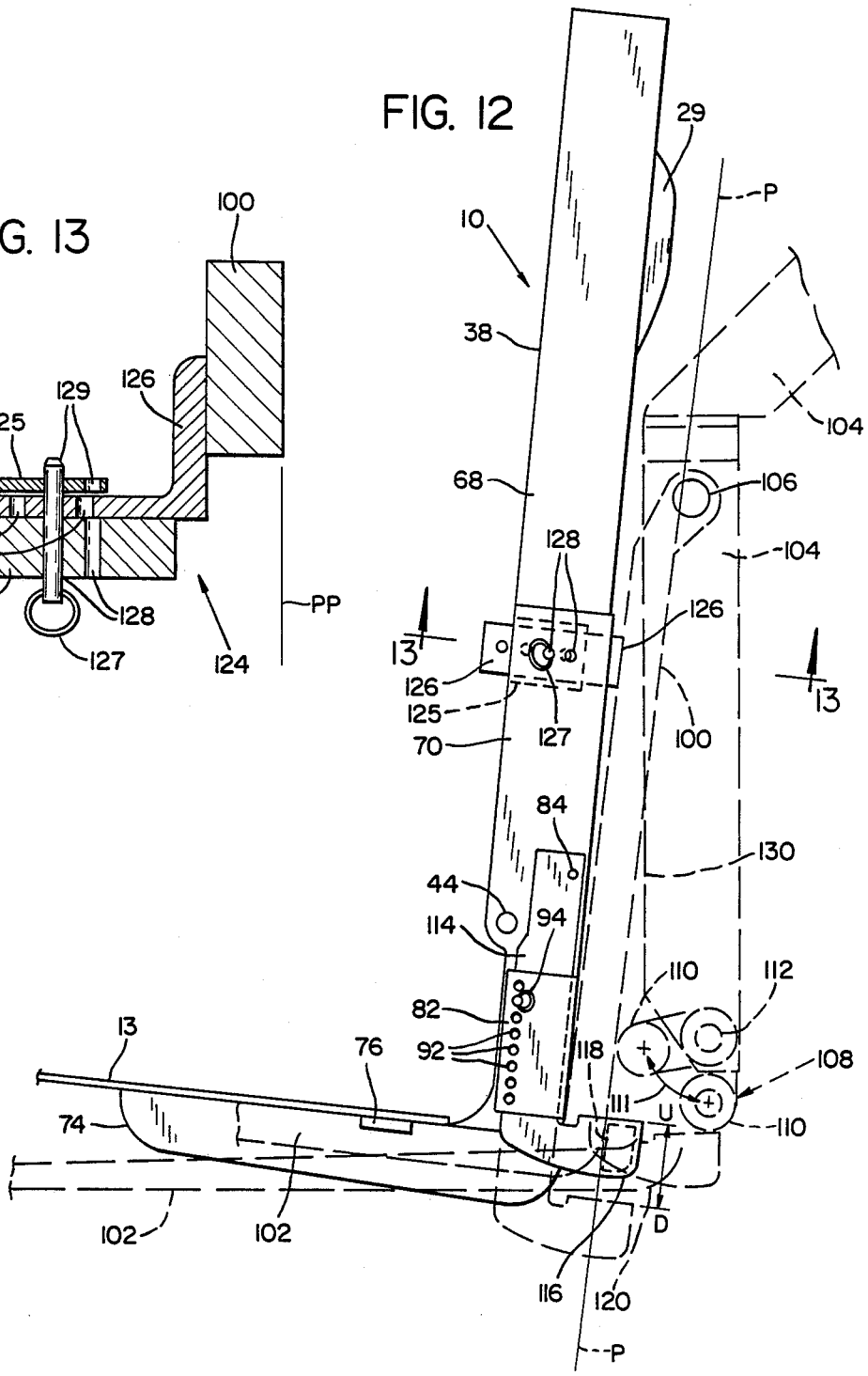
FIG. 12 is a side elevational view of a frame portion of the attachment with a slightly modified connector and shown mounted to one class of pin fork-type lift truck.

FIG. 12 shows a fork-mounted slip sheet handling attachment for a forklift truck having one known configuration of pin-type forks and carriage. The configuration shown is probably the most difficult pin-type fork-carriage assembly on which to mount the subject push-pull attachment, and therefore illustrates the versatility of the attachment. The attachment is identical to the one shown in FIGS. 1–9, with two exceptions. First, its fork connecting means has a slightly modified slide plate 114 which adapts it for connection to a pin-type fork. Second, a spacer assembly 124, also shown in FIG. 13, has been added to both lower side frame portions 70 to space these portions from the fork uprights 100 and to react upward platen tip loads against such uprights. Because of the identity of components in the attachments of FIGS. 1 and 12, the same reference numerals are used to identify corresponding components in both attachments.

A basic difference between an ITA-type fork carriage as depicted in FIGS. 2, 3, 6 and 7 and the type of pin-type fork carriage shown in FIG. 12 is that in the latter the fork uprights 100 of forks 102 are pivotally mounted at their upper ends to a lift carriage 104 by a pin or shaft 106. This enables the forks to tilt in vertical planes independently of any tilting movement of lift carriage 104. In contrast, on the ITA carriage 46, forks 52 can be tilted only by tilting the mast which mounts the lift carriage.

The pin 106 of the pin-type lift carriage is typically a shaft which extends from side to side of the carriage frame to pivotally mount both forks, which can be selectively positioned along the pin. Tilting movement of each fork is achieved through a pivoting roller mechanism, indicated generally at 108, mounted at the lower end of carriage 104. The roller mechanism mounts a roller 110 which bears against a lower rear surface of fork upright 100. Roller 110 is mounted between a pair of pivot arms 111. These arms are pivotally mounted at their inner ends at 112 for movement between a downwardly extending position shown in phantom in FIG. 12, and a forwardly projecting position shown in full lines in FIG. 12. Forward pivotal extension of roller 110 pushes the fork upright forward about pin 106, tilting the tine of fork 102 up as shown in full lines. When roller 110 pivots downward, fork upright 100 moves by gravity to a position beyond the vertical, moving the tine of fork 102 to the downwardly tilted position shown in phantom. The mechanism for operating the roller is conventional and located in a housing within the confines of the carriage. Commonly, carriage 104 is attached to a scissors mechanism on the lift truck, which raises and lowers the carriage while maintaining it in a vertical or other desired disposition.

When attachment 10 is mounted on pin-type forks as shown, frame uprights 38, 40 do not straddle fork uprights 100. Instead they are disposed in front of such uprights although still laterally outward of them and straddling the tines of the forks. It is necessary to modify the slide plate of the fork-connecting means slightly to accommodate this difference. The connecting means still includes the sleeve 82 and the vernier-type locking pin holes 92 and corresponding holes 93 in the lower portion 70 of each side frame member 38, 40. However, with the pin-type fork, the slide member 114 of the connector, although still J-shaped, must have a longer rearward projection of its foot portion 116 than with an ITA-type fork to enable its fork-connecting block 120 to reach behind the fork. The fork-engaging face 118 of block 120, like its ITA counterpart, engages the rear surface of the fork upright and moves in the reference plane P of such surface. Upon sliding movement of slide plate 114 between a raised position U shown in solid lines and a lowered position D shown in phantom lines, the fork-engaging face 118 travels in the reference plane P. Face 118 always engages the rear surface of the fork in its fork-engaging position, regardless of the thickness of such fork or the configuration of its heel.

Except for the longer frame support foot 116, the fork-connecting means for a pin-type fork is exactly the same in construction and operation as the corresponding connecting means previously described for an ITA-type fork. Similarly, support foot 116 functions to support the attachment in a free-standing position in the same manner and with the same advantages as described with respect to the foot 86 of the attachment of FIGS. 1–11. In fact, the two slide plates 80 and 114 are interchangeable on the same attachment, adapting it for connection to both types of forks.

Figure 13:
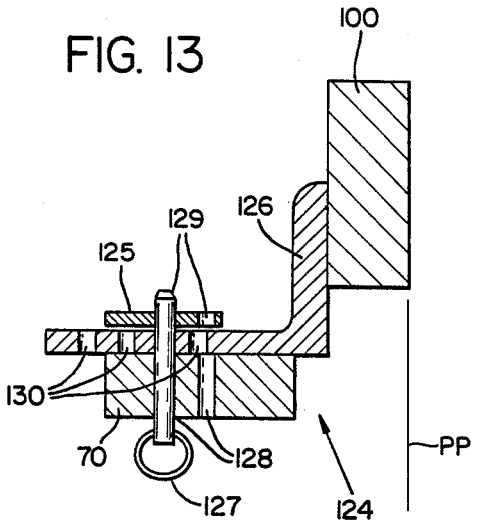
FIG. 13 is a sectional view taken along the line 13—13 of FIG. 12.

To space the attachment frame from the forklift carriage so that the frame or retracted pantograph link 29 does not hit carriage 104, spacer assembly 124 is added to both side frame members 70 as shown in FIGS. 12 and 13. Spacer assembly 124 includes an angular slide 126, slidable in a sleeve 125. The sleeve has rows of aligned holes 128, 129. The slide has corresponding holes 130 of slightly different spacing. A pull pin 127 is inserted through an aligned pair of sleeve holes 128, 129 and an aligned one of slide holes 130 to lock slide in abutment against the front face of fork upright 100. The sleeve and slide holes thus provide a vernier-type adjustment similar to that of the fork-connecting means. Slide 126 can be suitably adjusted to space side frame members 70 from fork uprights 100 without tools. The cooperation between the platens on the forks and these two spacers tend to keep the fork-engaging face 118 against the back of the fork uprights 100.

When the fork tines tilt down with the described carriage, the fork tilt cylinder housing tends to protrude between the forks. Because the frame of the attachment is open at the back, it can be positioned further back on the forks than if the frame were closed as on prior fork mounted attachments. This maximizes the net load capacity of this type of forklift truck with the attachment.

Another class of lift truck having pin-type forks employs a carriage which rides up and down a mast and tilts with the mast. The carriage incorporates a cross-carriage pin for mounting the forks but has a rigid heel bar instead of the described roller-type tilt mechanism. Thus, the forks tilt with and not relative to the carriage. With this type of carriage, spacer assembly 124 can be omitted.

(e) ITA bar adaptation

Figure 14:
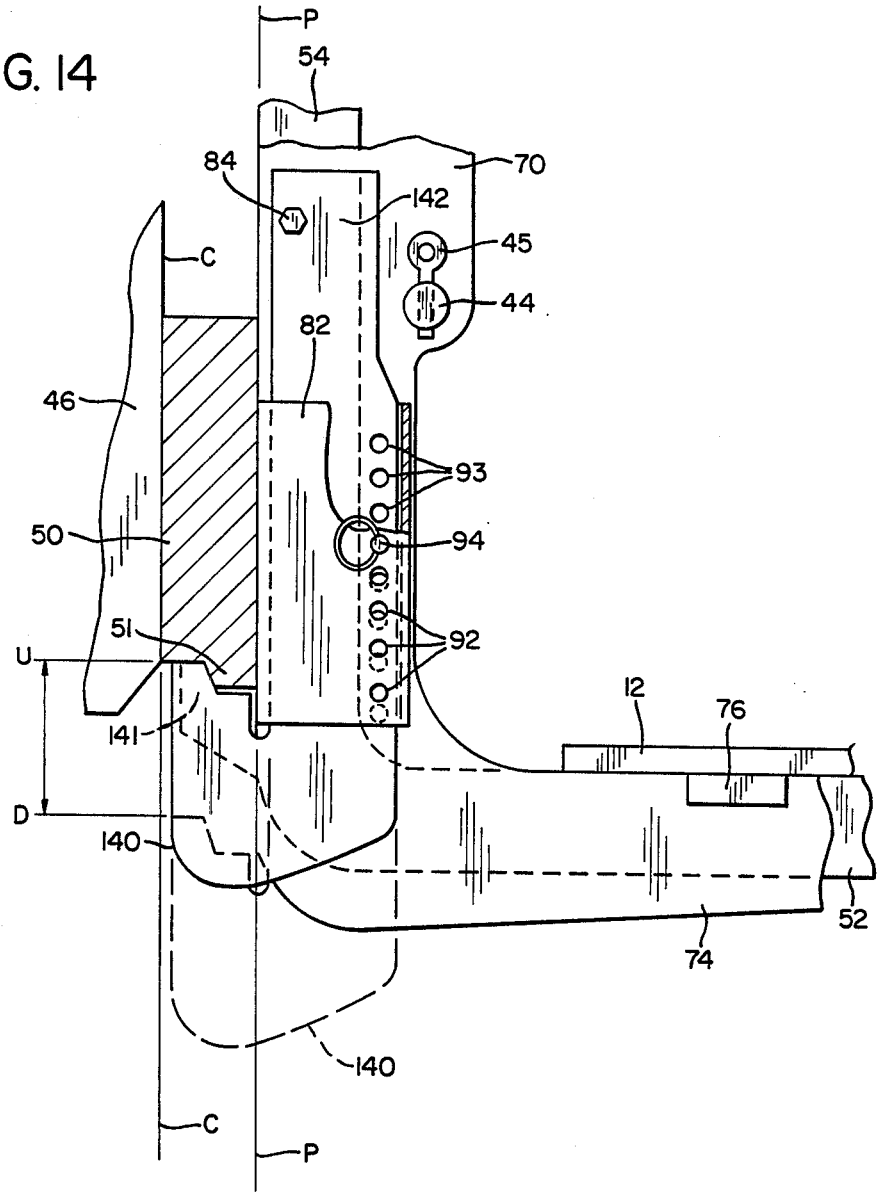
FIG. 14 is a view generally similar to FIG. 7 but showing the attachment with a modified forklift truck connecting means.

FIG. 14 shows the attachment of FIGS. 1–9, but with a frame support foot 140 which is a modification of foot 86 of FIG. 7. Foot 140 has no fork-engaging block 88. Instead, it has an upward projection 141 which complements the profile of the lower edge 51 of lower ITA bar 50 of an ITA carriage for engagement with such bar. The slide plate 142 which mounts foot 140 is otherwise shaped the same as slide plate 80. Thus, slide plates 142 and 80 are interchangeable on the same attachment 10 for the same purpose but connect the attachment to an ITA carriage in distinctly different ways. In FIG. 7, slide 80 with foot 86 and fork-connecting block 88 secure the attachment directly to the forks of any lift truck with an ITA carriage. In FIG. 14, slide 142 with foot 140 and top profile 141 secure the attachment only to the lower ITA bar of such a carriage.

Thus, the connecting means of the attachment, with its easily interchangeable slide plates, gives the attachment the versatility of being mountable on lift trucks with either ITA or pin-type carriages and being mountable on ITA carriages in two different ways, depending on user preference. Moreover, regardless of which slide plate configuration is used, its foot provides for stable self-support of the attachment in a free-standing position on a level support surface.

Operation

The use of the attachment will be described with reference to FIGS. 1–9, starting with the attachment in a free-standing position with the support foot 86 locked in its lower position as shown in FIG. 8.

The lift truck operator approaches the attachment from the rear. He lowers the lift truck forks 52 to a level below the bottom of the platens and above the top surface of fork engaging bar 88 and aligns them with the openings defined by the fork restrictor plate 64 and side frame ribs 74, as shown best in FIGS. 3, 5 and 8. He inserts the forks for a short distance through such openings and then lowers them to ride on top of bars 88. Insertion then continues until the rear surfaces of the side frame members abut the front faces of ITA bars 48 and 50 of the load carriage. When this occurs, the carriage is tilted rearward and the forks raised until the attachment is fully supported on the forks, with the platens at about eye level.

The carriage is then briefly jogged up and down to ensure that the attachment frame abuts the ITA bars. Then the operator exits the truck and lifts each slide plate 80 until the edge 90 of its connector block 88 engages the rear surface of the associated fork upright and the bottom surface of the fork's lower hook to the fullest extent possible. Locking pin 94 is then inserted in the aligned ones of pin holes 92 and 93 of sleeve 82 and slide 80, respectively, locking connecting block 88 in its latched fork-engaging position and frame support foot 86 in its raised position.

After the attachment is connected to the vehicle forks, the hydraulic hoses from the truck are coupled to the hydraulic hoses on the attachment at quick couplings (not shown) in a well-known manner. The attachment is now ready for use. Typically, the entire operation can be accomplished in less than one minute.

The lift truck operator reenters his truck and begins handling loaded slipsheets in the usual manner. This includes extension and retraction of the push-pull assembly and operation of the slip sheet gripping means as required from remote controls at the operator's station on the truck.

If two platens are used on the attachment, pallets can be handled also, if desired, without removing the attachment from the forks. In handling pallets, the push plate is retracted, and the platens inserted into the one generally open side of the pallet. The pallets are then handled in a conventional manner. The platens when so used act as wide pallet forks.

If a single platen is used, or if it is desired to handle pallets from both sides, the attachment must be removed from the forks. To remove the attachment from the forks, the push plate is fully retracted and the forks elevated to a convenient level. The lift truck operator then exits the truck, pulls locking pins 94 to release connecting blocks 88 from the forks and drops foot supports 86 to their frame-supporting positions, and then repins the slide plates to lock the feet in such positions. Then he uncouples the hydraulic hoses of the attachment from those of the lift truck and returns to the truck to lower the forks until support feet 86 engage ground surface G and support the base frame. He then tilts the vehicle mast so the platen tips touch the ground surface as shown in FIG. 8. Thereafter, he raises the forks only enough to clear fork engaging block 88 and the bottom of the platens. Then he backs the truck away from the attachment to retract the forks from beneath the platens and base frame, whereupon the truck is ready to handle pallets. Again, the entire removal operation can typically be accomplished in less than one minute.

Having described the principles of our invention by what is presently a preferred embodiment and several modifications thereof, it should be apparent to those skilled in the art that such embodiment may be modified in arrangement and detail without departing from such principles. We claim as our invention not only such embodiment but also all such modifications and equivalents thereof as come within the true spirit and scope of the following claims.

We claim:

1. A push-pull attachment for mounting on a forklift truck having a pair of load lifting forks mounted on a lift carriage, the forks including generally horizontally extending load-supporting fork portions and upright fork portions, the attachment comprising:

an upright base frame;

load-engaging platen means connected to and extending forwardly from said base frame;

a push-pull assembly connected to said base frame above said platen means including an upright push plate, extensible and retractable means for moving said push-plate inwardly and outwardly from said base frame above said platen means, and gripping means associated with said push plate to grip a slip sheet and pull it and a load supported thereon onto said platen means, connecting means on said base frame for connecting said base frame to the load-lifting forks of a lift truck to resist forward movement of the base frame relative to the lift carriage while the base frame, platen means and push-pull assembly are vertically supported on the forks, said connecting means comprising a movable fork-engaging means having a fork-engaging portion movable in the plane of a rear surface of an upright fork portion between an upper fork-engaging position engaging said rear surface and a lower fork-release position in disengagement from said rear surface when the attachment is mounted on the forks of a lift truck.

2. Apparatus according to claim 1 wherein said fork-engaging portion is positioned below the bottom surfaces of the load-supporting fork portions in said fork-release position.

3. Apparatus according to claim 1 wherein said base frame includes a pair of transversely spaced opposite side frame members, said connecting means being mounted for linear movement parallel to said plane along the outside, surfaces of said side frame members.

4. Apparatus according to claim 1 including vernier-type locking means for locking said fork-engaging portion in its fork-engaging and fork-release positions, said locking means including a quick-release pin.

5. Apparatus according to claim 1 including a base frame support foot for supporting the base frame in an elevated free-standing position for insertion and removal of the forks of a lift truck beneath said base frame and platen means when the attachment is detached from a lift truck, said support foot being movable between inactive and active positions upon movement of said fork-engaging portion between its fork-engaging and fork-release positions, said foot including a support portion extending rearwardly of said plane.

6. Apparatus according to claim 5 including vernier-type locking means on said base frame for locking said fork-engaging means and said foot in their respective said positions at the same time.

7. Apparatus according to claim 1 including a base frame support foot mounted on said frame for movement between a raised inactive position and lowered frame-supporting position extending below said base frame, said foot including a support portion extending rearwardly of the rearmost surfaces of said base frame when in said frame-supporting position.

8. A push-pull attachment for mounting on a forklift truck having a pair of load lifting forks mounted on a lift carriage, the forks including generally horizontally extending load-supporting fork portions and upright fork portions, the attachment comprising:

an upright base frame;

load-engaging platen means connected to and extending forwardly from said base frame;

a push-pull assembly connected to said base frame above said platen means including an upright push plate, extensible and retractable means for moving said push-plate inwardly and outwardly from said base frame above said platen means, and gripping means associated with said push plate to grip a slip sheet and pull it and a load supported thereon onto said platen means;

connecting means on said base frame for connecting said base frame to the load-lifting forks of a lift truck to resist forward movement of the base frame relative to the lift carriage while the base frame, platen means and push-pull assembly are vertically supported on the forks;

said base frame including transversely spaced apart upright side frame members disposed adjacent to the upright fork portions when said connecting means connect said base frame to the forks of a lift carriage having upper and lower crossbars for attaching the forks to the carriage;

said connecting means including movable fork-engaging means carried by said upright side frame members and having fork-engaging portions movable between fork-engaging positions in abutment against rear surfaces of the upright fork portions and fork-release positions disengaged from said rear surfaces;

9. Apparatus according to claim 8 wherein said connecting means includes frame support means movable with said fork-engaging means such that the frame support means move to frame support positions below said upright frame members upon movement of said fork-engaging surfaces to said fork release positions, said frame support means including frame support portions positioned rearwardly of said rear surfaces in said frame support positions.

10. Apparatus according to claim 9 wherein said fork-engaging means and frame support means are movable together parallel to said plane of said rear surfaces between their respective positions.

11. Apparatus according to claim 8 wherein said side frame members are disposed outwardly of the lateral limits of the forks and straddle the upright fork portions.

12. A push-pull attachment for mounting on a forklift truck having a carriage means including a pair of load lifting forks mounted on a lift carriage, the forks including generally horizontally extending load-supporting fork portions and upright fork portions, the attachment comprising:

an upright base frame;

load-engaigng platen means connected to and extending forwardly from said base frame;

a push-pull assembly connected to said base frame above said platen means including an upright push plate, extensible and retractable means for moving said push plate inwardly and outwardly from said base frame above said platen means, and gripping means associated with said push plate to grip a slip sheet and pull it and a load supported thereon onto said platen means;

connecting means for connecting said base frame to the carriage means of the forklift truck to resist forward movement of the base frame relative to the carriage means while the base frame, platen means and push-pull assembly are vertically supported on the forks;

said base frame including a pair of transversely spaced apart upright side frame members laterally offset from the forks of a lift truck with the base frame supported on the forks;

said connecting means including means mounted on lateral sides of said side frame members and moveable linearly along said side frame members between carriage-attaching, and carraige-release positions;

said connecting means comprising a fork-engaging means for engaging an upright fork portion.

13. Apparatus according to claim 12 wherein said connecting means includes slide means slidably mounted on said slides for generaly vertical sliding movement between said positions.

14. Apparatus according to claim 13 wherein each said slide means includes a foot portion projecting rearwardly of said side frame member and including said connecting means.

15. Apparatus according to claim 12 wherein said carraige-engaging means comprises a hook means for interengagement with the lower cross bar of the lift carriage.

16. Apparatus according to claim 14 wherein said foot portion comprises a frame-supporting foot including a ground-engaging portion rearwardly of said side frame members, said frame-supporting foot being movable to a-frame-supporting position upon movement of said connecting means to said carriage-release position and being movable to an upwardly retracted position upon movement of said connecting means to said carriage-attaching position.

17. Apparatus according to claim 12 wherein said fork-engaging means comprises means projecting transversely of said foot portion behind a rear surface of its associated side frame member for engagement with a rear surface of an associated fork upright portion.

18. Apparatus according to claim 17 wherein said fork-engaging means includes a fork-engaging surface portion positioned in the plane of the rear surface of the associated fork upright portion and movable in said plane between fork-engaging and fork-release positions.

19. Apparatus according to claim 13 including locking means for locking said slide means in said carriage-attaching position, said locking means including a locking pin means cooperable with locking pin holes in said slide means and said side frame member.

20. Apparatus according to claim 19 wherein said locking pin holes in said slide means and side frame member comprise a series of vernier holes in each arranged to provide a vernier-type adjustable locking means.

21. Apparatus according to claim 16 including locking means for simultaneously locking said connecting means and said frame-supporting means in their respective positions, said locking means comprising locking pin means cooperable with series of vernier-related locking pin holes in said slide means and its associated side frame member to provide an adjustable vernier-type locking means.

22. Apparatus according to claim 13 wherein each said slide means includes a slide plate slidably mounted in a slide sleeve affixed to said outer side of said side frame member, said slide plate being generally J-shaped including an upright slide portion and a foot portion projecting rearwardly beyond said side frame member from a lower end of said upright slide portion, said upright slide portion and slide sleeve having coincident rows of vernier-related locking pin holes for cooperation with a locking pin means to lock said slide means in adjusted said postions.

23. Apparatus according to claim 12 wherein said side frame members are positioned laterally outwardly of the forks and said connecting means are mounted on the laterally outer sides of the side frame members.

* * * * *

UNITED STATES PATENT AND TRADEMARK OFFICE

CERTIFICATE OF CORRECTION

PATENT NO. : 4,828,450

DATED : May 9, 1989

INVENTOR(S) : Donald R. Adamski, et al.

It is certified that error appears in the above-identified patent and that said Letters Patent is hereby corrected as shown below:

Column 11, line 7, "membrr" should be --member--.

Column 19, line 53, "engaigng" should be --engaging--.

Column 20, line 8, "carraige" should be --carriage--.

Column 20, line 14, "slides" should be --sides--.

Column 20, line 14, "generaly" should be --generally--.

Column 20, line 21, "carraige-engaging" should be --connecting--.

Column 20, line 63, omit the word "outer" between the words "said" and "side".

Signed and Sealed this

Nineteenth Day of February, 1991

*Attest:*

HARRY F. MANBECK, JR.

*Attesting Officer*

*Commissioner of Patents and Trademarks*